US010378765B2

(12) United States Patent
Stewart et al.

(10) Patent No.: US 10,378,765 B2
(45) Date of Patent: Aug. 13, 2019

(54) APPARATUS AND METHOD FOR DETECTING FURNACE FLOODING

(71) Applicant: Honeywell International Inc., Morris Plains, NJ (US)

(72) Inventors: Gregory E. Stewart, North Vancouver (CA); Wendy K. Foslien, Minneapolis, MN (US)

(73) Assignee: Honeywell International Inc., Morris Plains, NJ (US)

( * ) Notice: Subject to any disclaimer, the term of this patent is extended or adjusted under 35 U.S.C. 154(b) by 189 days.

(21) Appl. No.: 15/718,481

(22) Filed: Sep. 28, 2017

(65) Prior Publication Data

US 2018/0306444 A1 Oct. 25, 2018

Related U.S. Application Data

(60) Provisional application No. 62/489,045, filed on Apr. 24, 2017.

(51) Int. Cl.

| | |
|---|---|
| ***F23N 5/24*** | (2006.01) |
| ***F23N 5/18*** | (2006.01) |
| ***F23N 1/04*** | (2006.01) |
| ***F23N 5/00*** | (2006.01) |

(52) U.S. Cl.

CPC ..... *F23N 5/242* (2013.01); *F23N 1/042* (2013.01); *F23N 5/006* (2013.01); *F23N 5/18* (2013.01); *F23N 5/187* (2013.01); *F23N 2023/08* (2013.01); *F23N 2025/16* (2013.01); *F23N 2039/04* (2013.01); *F23N 2900/00* (2013.01)

(58) Field of Classification Search

CPC ..... F24N 5/18; F23N 5/24; F23N 5/26
USPC ..... 431/15, 170
See application file for complete search history.

(56) References Cited

U.S. PATENT DOCUMENTS 4,906,177 A * 3/1990 Newberry ..... F23N 5/203 431/46
6,126,913 A * 10/2000 Martin ..... B01J 8/025 423/245.3
7,459,060 B2 12/2008 Stewart
7,820,012 B2 10/2010 Stewart
(Continued)

FOREIGN PATENT DOCUMENTS

JP 2012172876 A * 10/2012 ..... F23N 5/24

OTHER PUBLICATIONS

U.S. Appl. No. 15/722,600, filed Oct. 2, 2017, 43 pages.
U.S. Appl. No. 15/722,664, filed Oct. 2, 2017, 40 pages.

*Primary Examiner* — Gregory L Huson
*Assistant Examiner* — Nikhil P Mashruwala
(74) *Attorney, Agent, or Firm* — Loza & Loza LLP; Kermit D. Lopez

(57) ABSTRACT

A method includes identifying a first steady-state gain associated with a relationship between a characteristic of a furnace and a setpoint used by a controller that is configured to control the characteristic of the furnace, The first steady-state gain is identified using data collected when the furnace is not suffering from flooding.
The method also includes identifying a second steady-state gain associated with the relationship during operation of the furnace. The method further includes comparing the first and second steady-state gains and identifying actual or potential flooding of the furnace based on the comparison.

22 Claims, 3 Drawing Sheets

(56) References Cited

U.S. PATENT DOCUMENTS

| | | | | |
|---|---|---|---|---|
| 2005/0166867 | A1* | 8/2005 | LaRue | F23L 9/02<br>122/7 R |
| 2010/0151397 | A1* | 6/2010 | Farrell | F23N 5/08<br>431/4 |
| 2015/0260398 | A1* | 9/2015 | Sun | F23N 5/242<br>110/341 |
| 2018/0259187 | A1* | 9/2018 | Lu | F23C 1/00 |
| 2018/0306442 | A1* | 10/2018 | Vitt | F23N 5/18 |
| 2018/0306443 | A1* | 10/2018 | Vitt | F23N 5/18 |

* cited by examiner

APPARATUS AND METHOD FOR DETECTING FURNACE FLOODING

CROSS-REFERENCE TO RELATED APPLICATION AND PRIORITY CLAIM

This application claims priority under 35 U.S.C. § 119(e) to U.S. Provisional Patent Application No. 62/419,045 filed on Apr. 24, 2017. This provisional application is hereby incorporated by reference in its entirety.

TECHNICAL FIELD

This disclosure generally relates to the monitoring of furnaces used for heating in industrial processes or other systems. More specifically, this disclosure relates to an apparatus and method for detecting furnace flooding.

BACKGROUND

Furnaces are used in a variety of industries and in a variety of ways to provide heating. For example, industrial processes in oil and gas refineries, chemical plants, or other industrial facilities often use furnaces to heat materials in order to facilitate desired chemical reactions. A furnace typically operates by receiving flows of fuel gas and inlet air, and the fuel gas combusts in the presence of the inlet air to produce heat. Ideally, the combustion of the fuel gas remains stable, and all or substantially all of the fuel gas entering the furnace is combusted.

Furnace flooding refers to a condition that can occur when the combustion of fuel gas in a furnace becomes unstable, such as when a ratio of the inlet air flow to the fuel gas flow moves outside of the furnace's operating envelope. When this occurs, the combustion process can become unstable or even stop, resulting in a total or partial loss of flame within the furnace. The loss of flame means that no fuel gas is being burned within the furnace. However, fuel gas may continue to be provided into the furnace, resulting in a build-up of uncombusted fuel gas in the furnace. In some circumstances, this could lead to an explosion of the furnace.

SUMMARY

This disclosure provides an apparatus and method for detecting furnace flooding.

In a first embodiment, a method includes identifying a first steady-state gain associated with a relationship between a characteristic of a furnace and a setpoint used by a controller that is configured to control the characteristic of the furnace. The first steady-state gain is identified using data collected when the furnace is not suffering from flooding. The method also includes identifying a second steady-state gain associated with the relationship during operation of the furnace. The method further includes comparing the first and second steady-state gains and identifying actual or potential flooding of the furnace based on the comparison.

In a second embodiment, an apparatus includes at least one processing device configured to identify a first steady-state gain associated with a relationship between a characteristic of a furnace and a setpoint used by a controller that is configured to control the characteristic of the furnace, using data collected when the furnace is not suffering from flooding. The at least one processing device is also configured to identify a second steady-state gain associated with the relationship during operation of the furnace, In addition, the at least one processing device is configured to compare the first and second steady-state gains and identify actual or potential flooding of the furnace based on the comparison.

In a third embodiment, a non-transitory computer readable medium contains instructions that when executed cause at least one processing device to identify a first steady-state gain associated with a relationship between a characteristic of a furnace and a setpoint used by a controller that is configured to control the characteristic of the furnace, using data collected when the furnace is not suffering from flooding. The medium also contains instructions that when executed cause the at least one processing device to identify a second steady-state gain associated with the relationship during operation of the furnace. In addition, the medium contains instructions that when executed cause the at least one processing device to compare the first and second steady-state gains and identify actual or potential flooding of the furnace based on the comparison.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 4, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
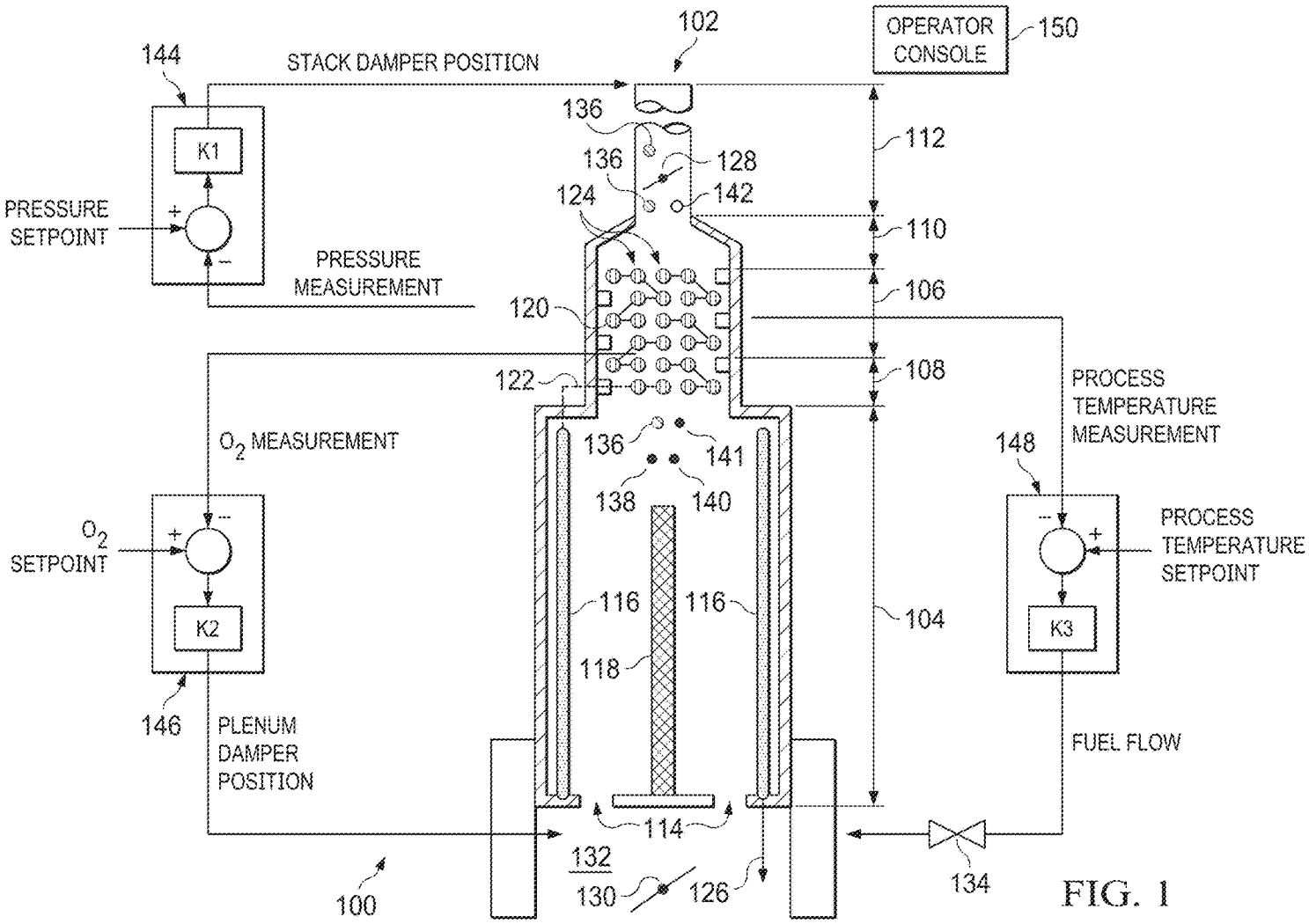
FIG. 1 illustrates an example system for detecting furnace flooding according to this disclosure.

FIG. 1 illustrates an example system 100 for detecting furnace flooding according to this disclosure. As shown in FIG. 1, the system 100 includes or operates in conjunction with a furnace 102. The furnace 102 generally operates by receiving at least one fuel gas flow and at least one inlet air flow, The fuel gas is ignited within the furnace 102 and burns in the presence of oxygen contained in the inlet air, thereby producing heat. The generated heat can be used to heat one or more materials, such as one or more flows of fluid (like one or more gases or liquids) in a process flow.

In the example shown in FIG. 1, the furnace 102 includes a radiant section 104, a convection section 106, a shield section 108, a breech 110, and a stack 112. The radiant section 104 is generally configured to transfer radiant heat into one or more materials being heated, while the convection section 106 is generally configured to pre-heat the one or more materials before the materials enter the radiant section 104. The shield section 108 generally separates the radiant section 104 from the convection section 106 and helps to protect the convection section 106 from direct radiant heating. The breech 110 generally denotes the transition from the convection section 106 to the stack 112, and the stack 112 generally allows exhaust to exit the furnace 102.

The radiant section 104 of the furnace 102 in FIG. 1 includes one or more burners 114, which are configured to ignite fuel gas entering the furnace 102. The heat created when the fuel gas burns radiates into one or more radiant tubes 116, which contain the one or more materials being heated. A bridgewall 118 divides the lower portion of the radiant section 104 into different spaces to facilitate more effective heating by the burners 114. Each burner 114 includes any suitable structure for igniting and burning fuel gas. Each radiant tube 116 includes any suitable structure for transporting material that is being heated. The bridgewall 118 includes any suitable structure for dividing a space.

The convection section 106 and the shield section 108 of the furnace 102 in FIG. 1 include one or more coils 120. which are connected to the one or more radiant tubes 116 via one or more crossovers 122. The coils 120 receive the one or more materials to be heated through one or more inlets 124, and the materials travel through the coil(s) 120 to the radiant tube(s) 116 before exiting through one or more outlets 126. The coils 120 can travel back and forth in the space between the radiant section 104 and the stack 112. By passing the one or more materials through the coils 120, the materials can be pre-heated in the convection section 106 before the materials are heated in the radiant section 104. Each coil 120 includes any suitable structure for transporting material being heated. Each crossover 122 includes any suitable structure for linking a coil and a radiant tube.

A stack damper 128 is located at or near the top of the furnace 102 and is used to control the flow of exhaust out of the furnace 102 through the stack 112. For example, the stack damper 128 could denote a flat circular, square, or other structure that can be rotated to change the size of a passageway through the stack 112. Similarly, a plenum damper 130 is located at or near the bottom of the furnace 102, such as within a plenum chamber 132. The plenum damper 130 is used to control the flow of inlet air into the furnace 102. The plenum damper 130 could denote a flat circular, square, or other structure that can be rotated to change the size of a passageway through the plenum chamber 132. The plenum chamber 132 denotes an area where fuel gas and inlet air are received and mixed before entering the furnace 102. A valve 134 or other structure could be used to control the flow of fuel gas into the furnace 102 at or near the bottom of the furnace 102, such as into the plenum chamber 132. Each damper 128 and 130 includes any suitable structure for controlling fluid flow. The plenum chamber 132 includes any suitable structure for receiving and providing fluid. The valve 134 includes any suitable structure for controlling a fuel gas flow.

Various sensors can be positioned within or otherwise used in conjunction with the furnace 102. For example, one or more draft gauges 136 could be used to measure airflow through one or more portions of the furnace 102. One or more oxygen sensors 138 could be used to measure the oxygen level at one or more locations within the furnace 102. One or more pressure sensors 140 could be used to measure the pressure level at one or more locations within the furnace 102. One or more sensors 141 could be used to measure an amount of combustible material at one or more locations within of the furnace 102. One or more temperature sensors 142 could be used to measure the temperature at one or more locations within the furnace 102 or to measure the temperature of a process fluid (the material being heated by the furnace 102).

Each of the sensors 136-142 includes any suitable structure for measuring one or more characteristics in or associated with a furnace. As particular examples, the sensors could include THERMOX combustion analyzers or combustion analyzers using tunable diode lasers. Note that the numbers and positions of the various types of sensors in FIG. 1 are for illustration only. Any number of each type of sensor and any suitable arrangement of those sensors could be used in the furnace 102. Also note that any other or additional types of sensors could be used in the furnace 102.

This represents a brief description of one type of furnace 102 that may be used to produce heat. Additional details regarding this type of furnace 102 are well-known in the art and are not needed for an understanding of this disclosure. Note that the general structure of the furnace 102 shown in FIG. 1 is for illustration only. Furnaces can come in a wide variety of designs and configurations, and the example of the furnace 102 shown in FIG. 1 is for illustration only.

The system 100 also includes multiple controllers 144-148 that are used to control various aspects of the furnace's operation. For example, a pressure controller 144 receives pressure measurements and a pressure setpoint. Based on differences between the pressure measurements and the pressure setpoint, the controller 144 generates a control signal to vary the position or opening of the stack damper 128. An oxygen controller 146 receives oxygen level measurements and an oxygen level setpoint. Based on differences between the oxygen level measurements and the oxygen level setpoint, the controller 146 generates a control signal to vary the position or opening of the plenum damper 130. A temperature controller 148 receives temperature measurements and a temperature setpoint. Based on differences between the temperature measurements and the temperature setpoint, the controller 148 generates a control signal to vary the amount of fuel gas entering the furnace 102, such as by adjusting the valve 134 that controls the fuel gas flow.

Each controller 144-148 includes any suitable structure for controlling one or more aspects associated with a furnace. Each controller 144-148 could, for example, represent a proportional-integral-derivative controller, or the controllers 144-148 could be collected into a single multivariable controller, such as a controller implementing model predictive control or other advanced predictive control. As a particular example, each controller 144-148 or combination of controllers 144-148 could represent a computing device running a real-time operating system, a WINDOWS operating system, or other operating system.

Note that while three controllers 144-148 are shown here, other numbers of controllers could also be used. For example, additional controllers could be used to control additional aspects associated with the furnace 102. As another example, the functionality of the three controllers 144-148 could be combined into less than three controllers. As a particular example, the controllers 144-148 are shown here as forming part of three single-input, single-output (SISO) control loops, but other configurations could also be used, such as multivariable control approaches.

Operator access to and interaction with the controllers 144-148 and other components of the system 100 can occur via one or more operator consoles 150. Each operator console 150 could be used to provide information to an operator and receive information from an operator. For example, each operator console 150 could provide information identifying a current state of the furnace 102 to the operator, such as values of various process variables and warnings, alarms, or other states associated with the furnace 102. Each operator console 150 could also receive information affecting how the furnace 102 is controlled, such as by receiving setpoints for process variables controlled by the controllers 144-148 or other information that alters or affects how the controllers 144-148 control the furnace 102. Each operator console 150 includes any suitable structure for displaying information to and interacting with an operator. For example, each operator console 150 could represent a computing device running a WINDOWS operating system or other operating system.

As noted above, furnace flooding can occur when the combustion of fuel gas in the furnace 102 becomes unstable, such as when a ratio of the inlet air flow to the fuel gas flow moves outside of the furnace's operating envelope. Various causes may exist for furnace flooding. For example, if an oxygen sensor 138 in the furnace 102 clogs or otherwise fails to operate correctly, the oxygen sensor 138 could generate oxygen level measurements that are higher than the actual oxygen level. This may cause the controller 146 to close the plenum damper 130 more than needed, which reduces the amount of inlet air (and therefore oxygen) in the furnace 102 and can cause the combustion to become unstable. When this occurs, a total or partial loss of flame within the furnace 102 can occur, which creates risk since the fuel gas may continue to be provided into the furnace 102. The resulting build-up of uncombusted fuel gas in the furnace 102 can lead to an explosion of the furnace 102.

Since at least some of the fuel gas that is input into the furnace 102 goes uncombusted during a loss of flame, that fuel gas is essentially unavailable to provide heat to a process flow. In control engineering terms, this means that the gain from the input fuel gas to the process flow enthalpy decreases during a loss of flame. Furnace flooding could therefore be detectable by identifying a change in the efficiency of the transfer of heat from the fuel gas to a process fluid. However, a complicating factor is that the fuel gas flow is often connected to the process flow enthalpy via a temperature control feedback loop (namely one that includes the controller 148). It is a well-known problem that identifying a closed-loop gain is more difficult that identifying an open-loop gain.

As described in more detail below, this disclosure provides a technique for identifying when flooding of a furnace 102 is occurring or may occur. In this technique, an open-loop model identification approach is used to identify the gain from the temperature setpoint of the furnace 102 to the fuel flow for the furnace 102 while the temperature control is in closed-loop. The closed-loop transfer function for the temperature setpoint to fuel flow relationship can be identified using an open-loop model identification technique, and there are various tools known in the art for performing open-loop model identification. If an integrating control approach is used in the controller 148, its steady-state gain is the inverse of the steady-state gain from the fuel flow to the temperature. If the identified gain changes significantly, the change is an indication that furnace flooding has occurred or is approaching. An alarm or other signal could then be generated, such as for display on the operator console 150. Additional details regarding this technique are provided below. It should also be noted that other or additional relationships could be used to identify furnace flooding instead of or in addition to a temperature setpoint-to-fuel flow relationship.

This technique could be implemented using any suitable device(s) within or coupled to the system 100. For example, the technique could be implemented using the controller 148, the operator console 150, or a server or other computing device communicatively coupled to the controller 148 or the operator console 150. The technique could also be implemented using a server or other computing device outside of the system and communicatively coupled to the system 100. As a particular example, this technique could be implemented within a computing cloud or a remote server.

Although FIG. 1 illustrates one example of a system 100 for detecting furnace flooding, various changes may be made to FIG. 1. For example, the system 100 could include any number of furnaces, sensors, actuators, controllers, operator consoles, and other components. While three controllers 144-148 are shown here, one or more of these controllers could be omitted. This could be done, for instance, if the flooding detection approach described in this patent document does not rely on measurements obtained by or calculations performed using those controllers. Also, the makeup and arrangement of the system 100 in FIG. 1 is for illustration only. Components could be added, omitted, combined, further subdivided, or placed in any other suitable configuration according to particular needs. Further, particular functions have been described as being performed by particular components of the system 100. This is for illustration only. In general, control or automation systems are highly configurable and can be configured in any suitable manner according to particular needs. In addition, while FIG. 1 illustrates one example operational environment where the detection of furnace flooding can be used, this functionality can be used in any other suitable system.

Figure 2:
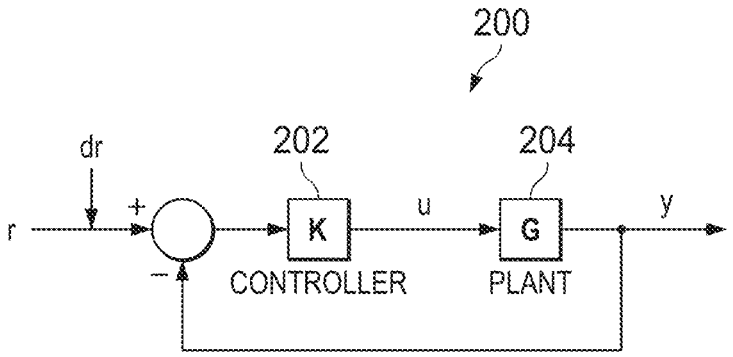
FIG. 2 illustrates an example control approach for detecting furnace flooding according to this disclosure.

FIG. 2 illustrates an example control approach 200 for detecting furnace flooding according to this disclosure. For ease of explanation, the control approach 200 shown in FIG. 2 may be described as being used in the system 100 of FIG. 1. However, the control approach 200 could be used in any other suitable system and with any other suitable furnace.

As shown in FIG. 2, a controller (K) 202 is used to control at least one aspect of a plant (G) 204. The controller 202 could denote the temperature controller 148 in FIG. 1, and the plant 204 could represent the furnace 102 of FIG. 1. The controller 202 operates to generate an actuator control signal u, such as a signal for adjusting the valve 134 that controls the flow of fuel gas into the furnace 102. The controller 202 generates the actuator control signal u based on measurements y of the plant 204, such as temperature measurements. The controller 202 attempts to adjust the actuator control signal u so that differences between the measurements y and a setpoint r are reduced or eliminated.

A change in the steady-state gain of the plant 204 could be used as an indicator of furnace flooding. The gain can form part of a transfer function for the temperature setpoint-to-fuel flow relationship (or other relationship). In conventional approaches, the identification of the transfer function could be accomplished by introducing perturbations in the actuator control signal u when the controller 202 is not operating (so the control loop is referred to as an open loop). In a closed-loop control system, this is difficult because the controller 202 is actually in operation. If the controller 202 is designed with integral action, additive perturbations introduced into the actuator control signal u are typically attenuated by the controller 202. The control action by the controller 202 therefore makes it difficult to identify the steady-state gain based on perturbations to the actuator control signal u.

The approach taken in FIG. 2 is to introduce setpoint perturbations dr in the setpoint r used by the controller 202. For example, if the furnace 102 has a normal temperature setpoint of 800° F., the setpoint could be changed to 810° F. or 790° F. and then returned to 800° F. after a period of time.

Of course, other setpoint perturbations could be used. The period of time during which the setpoint perturbation lasts can vary depending on a number of factors, but it is generally long enough to obtain an accurate assessment of the steady-state gain. In some embodiments, this could be at least as long as the closed-loop time constant of the system and possibly a multiple of the closed-loop time constant (such as a multiple of two or three)

By making perturbations dr to the setpoint r instead of to the actuator control signal u, this allows open-loop model identification to be used to identify the steady-state gain, even when the controller 202 is operating to control the furnace 102 using closed-loop control. The closed-loop transfer function from dr to u could be expressed as:

$$u(t)=R(z)dr(z)$$

$$u=K(I+GK)^{-1}dr$$

Identifying this transfer function is an open-loop identification problem and, as such, may be significantly easier than performing closed-loop identification. If the controller 202 contains an integrator, the steady-state relationship can be expressed as:

$$u_{SS}=(Gss)^{-1}dr_{ss}$$

The gain Gss is used to connect the efficiency of heat transfer from the fuel gas to the process fluid by the furnace 102. Thus, changes in the gain Gss may be symptomatic of furnace flooding. Based on this, the process described below could be used to identify actual or potential furnace flooding based on changes to the calculated gain.

Note that while introducing perturbations and performing open-loop model identification to detect gain changes is described here, other approaches could also be used. For example, no setpoint perturbations may be needed, and closed-loop model identification could be performed repeatedly using closed-loop data. The closed-loop model identification is performed to identify one or more steady-state gains of the furnace, such as the gain from fuel u to measured temperature y. Changes in the values of the steady-state gain(s) over time could then be used as an indicator of furnace flooding.

Although FIG. 2 illustrates one example of a control approach 200 for detecting furnace flooding, various changes may be made to FIG. 2. For example, the controller 202 could be a multivariable controller that operates within multiple control loops. Also, while often described as using fuel gas flow and a temperature setpoint to identify flooding, any other or additional value(s) and setpoint(s) could be used.

Figure 3:
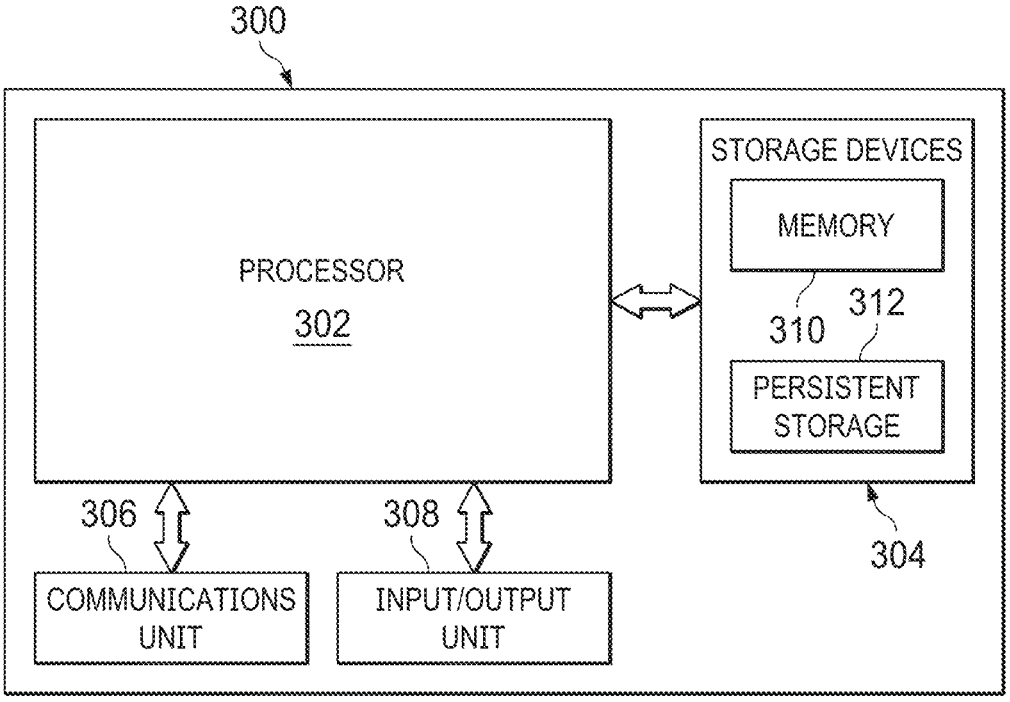
FIG. 3 illustrates an example device for detecting furnace flooding according to this disclosure.

FIG. 3 illustrates an example device 300 for detecting furnace flooding according to this disclosure. The device 300 could, for example, denote any of the controllers, operator stations, or other devices in or used in conjunction with the system 100 in FIG. 1. The device 300 could also represent the computing device that implements part or all of the control approach 200 in FIG. 2. However, the device 300 could be used in any other suitable system.

As shown in FIG. 3, the device 300 includes at least one processor 302, at least one storage device 304, at least one communications unit 306, and at least one input/output (I/O) unit 308. Each processor 302 can execute instructions, such as those that may be loaded into a memory 310. The instructions could implement the furnace flooding detection functionality described in this patent document. Each processor 302 denotes any suitable processing device, such as one or more microprocessors, microcontrollers, digital signal processors, application specific integrated circuits (ASICs), field programmable gate arrays (FPGAs), or discrete circuitry.

The memory 310 and a persistent storage 312 are examples of storage devices 304, which represent any structure(s) capable of storing and facilitating retrieval of information (such as data, program code, and/or other suitable information on a temporary or permanent basis). The memory 310 may represent a random access memory or any other suitable volatile or non-volatile storage device(s). The persistent storage 312 may contain one or more components or devices supporting longer-term storage of data, such as a read only memory, hard drive, Flash memory, or optical disc.

The communications unit 306 supports communications with other systems or devices. For example, the communications unit 306 could include a network interface card or a wireless transceiver facilitating communications over a wired or wireless network. The communications unit 306 may support communications through any suitable physical or wireless communication link(s).

The I/O unit 308 allows for input and output of data. For example, the I/O unit 308 may provide a connection for user input through a keyboard, mouse, keypad, touchscreen, or other suitable input device. The I/O unit 308 may also send output to a display, printer, or other suitable output device.

Although FIG. 3 illustrates one example of a device 300 for detecting furnace flooding, various changes may be made to FIG. 3. For example, components could be added, omitted, combined, further subdivided, or placed in any other suitable configuration according to particular needs. Also, computing devices can come in a wide variety of configurations, and FIG. 3 does not limit this disclosure to any particular configuration of computing device.

Figure 4:
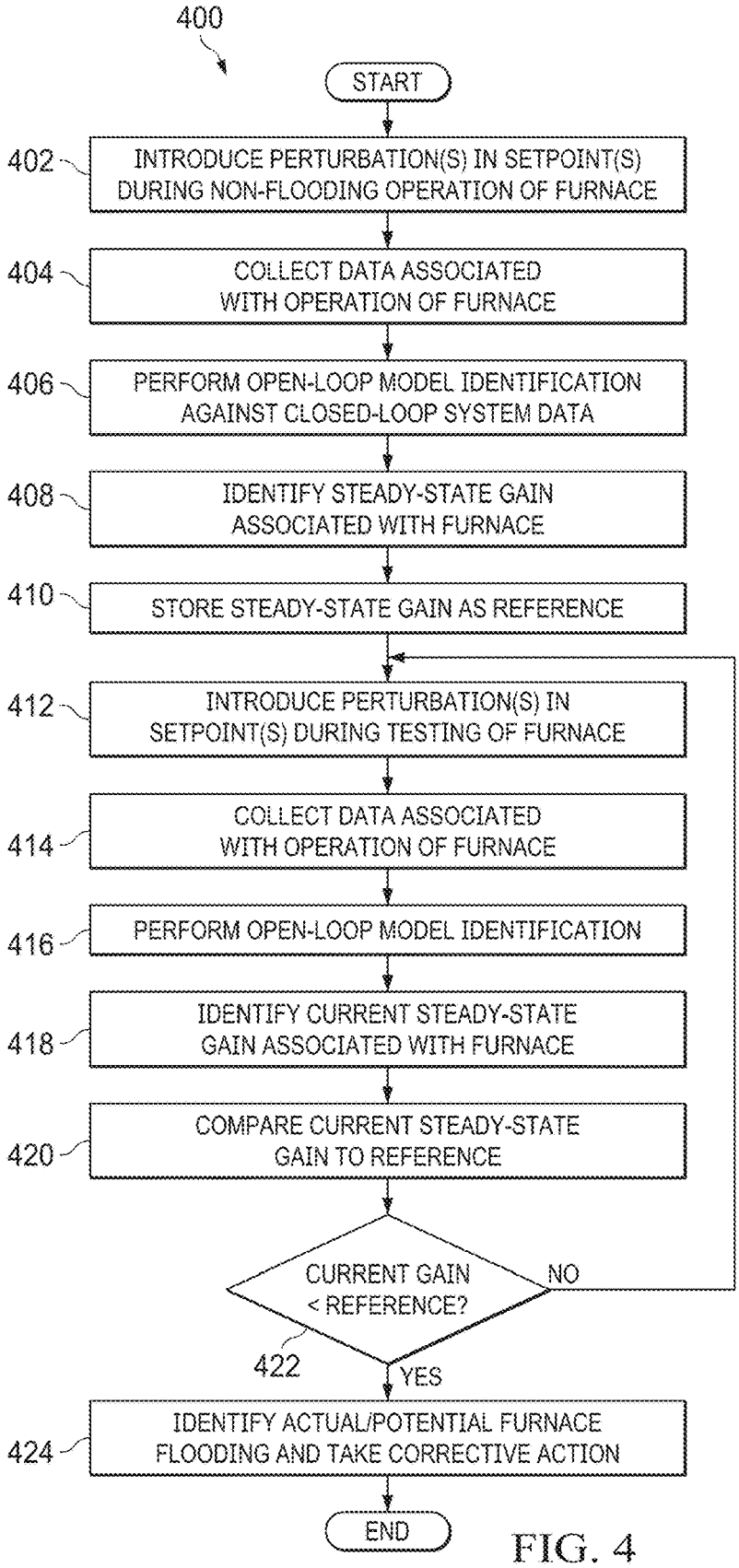
FIG. 4 illustrates an example method for detecting furnace flooding according to this disclosure.

FIG. 4 illustrates an example method 400 for detecting furnace flooding according to this disclosure. For ease of explanation, the method 400 is described as being performed by the device 300 in FIG. 3 to implement part or all of the control approach 200 in FIG. 2 within the system 100 of FIG. 1. However, the method 400 could be used with any other suitable device and in any other suitable system. Also note that the method 400 in FIG. 4 could be automated or involve human operator interaction.

As shown in FIG. 4, one or more perturbations are introduced into one or more setpoints used h at least one controller associated with a furnace at step 402, and data associated with operation of the furnace is collected at step 404. This could include, for example, a processor 302 in a controller 202 or another component introducing one or more perturbations dr into a setpoint r used by the controller 202. Each perturbation dr denotes a small change to the setpoint r for the controller 202. This could occur during times when furnace flooding is not suspected or occurring so that an accurate baseline can be established for the furnace 102. The collected data could include any suitable data, such as values of the measurements y, the actuator control signal u, the setpoint r, and the perturbation(s) dr. As a particular example, this could include the controller 148 or another component changing the temperature setpoint for the furnace 102 by a small amount and collecting data associated with the resulting temperature measurements or with the resulting control signal for the valve 134. This data represents closed-loop data since it is collected during operation of the controller(s).

Open-loop model identification is performed using at least some of the collected information at step 406, and a steady-state gain associated with at least one aspect of the furnace is identified at step 408. This could include, for example, the processor 302 in the controller 202 or another component performing open-loop model identification using the {dr, u} data to identify an overall plant gain R(z) for the furnace 102. As noted above, there are various tools known in the art for performing open-loop model identification. This could also include extracting the steady-state gain $Gss=R(I)^{-1}$. The calculated steady-state gain is stored as a baseline or reference gain at step 410. This could include, for example, the processor 302 in the controller 202 or another component storing the steady-state gain as a non-flooding reference gain $G_{nrg}$ in a memory 310 or persistent storage 312.

One or more perturbations are again introduced into the one or more setpoints used by the at least one controller associated with the furnace at step 412, and data associated with operation of the furnace is again collected at step 414. This could include, for example, the processor 302 in the controller 202 or another component introducing one or more perturbations dr into the setpoint r used by the controller 202. This could occur during times when the furnace 102 is being tested in order to detect actual or potential furnace flooding. The collected data could include any suitable data, such as values of the measurements y, the actuator control signal u, the setpoint r. and the perturbation(s) dr. As a particular example, this could include the controller 148 or another component changing the temperature setpoint for the furnace 102 by a small amount and collecting data associated with the resulting temperature measurements or with the resulting control signal for the valve 134.

Open-loop model identification is performed using at least some of the collected information at step 416, and a current steady-state gain associated with at least one aspect of the furnace is identified at step 418. This could include, for example, the processor 302 in the controller 202 or another component performing open-loop model identification using the {dr, u} data to identify a current overall plant gain R(z) for the furnace. This could also include extracting the steady-state gain $Gss=R(I)^{-1}$ as the current steady-state gain for the furnace 102.

The current steady-state gain is compared to the stored reference gain at step 420, and a determination is made whether the current steady-state gain is less than the stored reference gain at step 422. This could include, for example, the processor 302 in the controller 202 or another component determining whether the current steady-state gain Gss is significantly smaller than the reference gain $G_{nrg}$ (such as by more than a threshold amount or percentage). If not, the method returns to step 412 to again cause additional perturbations and collect additional data for analysis. This could occur repeatedly (such as at a specified interval), during times when furnace flooding is suspected, or at other times. As particular examples, this could occur at a regular interval, such as hourly, daily, or weekly, depending on an expected rate at which the gain change may be expected to appear. This could also or alternatively be used as part of a diagnostic tool, such as one that is manually initiated by a user when the user is interested in assessing whether actual or potential flooding appears to be taking place.

If the current steady-state gain from fuel to temperature is less than the stored reference gain (or is less than the stored reference gain by some threshold amount or percentage), furnace flooding may be occurring or may be possible, and corrective action could occur at step 424. This could include, for example, the processor 302 in the controller 202 or another component generating an alarm or stopping the flow of fuel gas into the furnace (such as by closing the valve 134). Any other or additional actions could also occur in response to actual or potential furnace flooding. Once the actual or potential furnace flooding condition has cleared, the process could return to step 412 to collect additional information, or the process could return to step 402 to identify a new baseline or reference steady-stage gain.

Although FIG. 4 illustrates one example of a method 400 for detecting furnace flooding, various changes may be made to FIG. 4. For example, while shown as a series of steps, various steps in FIG. 4 could overlap, occur in parallel, occur in a different order, or occur any number of times. As another example, while shown as identifying actual or potential furnace flooding in response to a single steady-stage gain being less than the reference gain, corrective action could be delayed until it has been determined that multiple steady-stage gains are less than the reference gain. The number of steady-stage gains that should be less than the reference gain before corrective action occurs could be user-configurable. In addition, as noted above, the use of setpoint perturbations and open-loop model identification is not required. Other approaches that repeatedly identify at least one process gain and any changes in the process gains could be used, such as those that involve performing closed-loop model identification without setpoint perturbations.

Note that while approaches for detecting furnace flooding using specific data (such as a temperature setpoint-to-fuel flow relationship) are described above, these approaches are examples only. Other approaches could also be used to identify furnace flooding. For example, a wide variety of sensor data related to operation of a furnace 102 could be obtained. Examples of the sensor data could include fuel gas flow rate, fuel gas composition, oxygen level at one or more locations of a furnace 102 (such as in the stack 112), combustible level at one or more locations of a furnace 102 (such as in the stack 112), plenum damper position, stack damper position, temperature at one or more locations of a furnace 102 (such as in the stack 112), temperature of process fluid being heated, and pressure at one or more locations of a furnace 102 (such as in the stack 112). One, some, or all of these values could be used in one or more control loops to control the operation of the furnace 102. One or more setpoints in any of these control loops could be perturbed periodically to identify actual or potential furnace flooding, as long as the gain or gains used in the control loop or control loops are affected by flooding.

It is also possible to use the same techniques described above with multiple relationships to generate multiple indicators of whether furnace flooding is occurring or may be about to occur. For example, different setpoints for different process variables could be perturbed at different times, and different gains could be identified based on those perturbations. Some of those gains could be used as baseline or reference gains, while other gains could be compared to the baseline or reference gains in order to generate multiple individual indicators of actual or possible furnace flooding. An overall indicator of actual or possible furnace flooding could then be generated based on the individual indicators. For instance, the overall indicator could indicate that furnace flooding is occurring if many or all of the individual indicators indicate furnace flooding, or the overall indicator could indicate that furnace flooding is possible but not yet confirmed if several of the individual indicators indicate furnace flooding. Of course, any other logic for combining individual indicators into an overall indicator could also be used.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable storage device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

identifying a first steady-state gain associated with a relationship between a characteristic of a furnace and a setpoint used by a controller that is configured to control the characteristic of the furnace, the first steady-state gain identified using data collected when the furnace is not suffering from flooding;

identifying a second steady-state gain associated with the relationship during operation of the furnace;

comparing the first and second steady-state gains; and identifying actual or potential flooding of the furnace based on the comparison.

2. The method of claim 1, wherein:

the second steady-state gain is identified using data collected when the controller is operating in a closed-loop mode to control the characteristic of the furnace; and the controller is configured to receive measurements from one or more sensors and generate one or more actuator control signals when operating in the closed-loop mode.

3. The method of claim 1, wherein:

the setpoint comprises a temperature setpoint;

the characteristic of the furnace comprises a flow rate of fuel gas into the furnace; and the controller is configured to control the flow rate of fuel gas into the furnace based on the temperature setpoint.

4. The method of claim 1, wherein the second steady-state gain is identified using data collected after one or more perturbations in the setpoint.

5. The method of claim 4, wherein:

the setpoint comprises a temperature setpoint; and the one or more perturbations in the setpoint comprise one or more changes in the temperature setpoint.

6. The method of claim 1, wherein the second steady-state gain is identified repeatedly during the operation of the furnace.

7. The method of claim 1, further comprising:

in response to identifying actual or potential flooding of the furnace, at least one of: generating an alert, altering the operation of the furnace, and stopping the operation of the furnace.

8. An apparatus comprising:

at least one processing device configured to:

identify a first steady-state gain associated with a relationship between a characteristic of a furnace and a setpoint used by a controller that is configured to control the characteristic of the furnace, using data collected when the furnace is not suffering from flooding;

identify a second steady-state gain associated with the relationship during operation of the furnace;

compare the first and second steady-state gains; and identify actual or potential flooding of the furnace based on the comparison.

9. The apparatus of claim 8, wherein the at least one processing device is configured to identify the second steady-state gain using data collected when the controller is operating in a closed-loop mode to control the characteristic of the furnace.

10. The apparatus of claim 8, wherein:

the setpoint comprises a temperature setpoint; and the characteristic of the furnace comprises a flow rate of fuel gas into the furnace.

11. The apparatus of claim 8, wherein the at least one processing device is configured to identify the second steady-state gain using data collected after one or more perturbations in the setpoint.

12. The apparatus of claim 11, wherein:

the setpoint comprises a temperature setpoint; and the one or more perturbations in the setpoint comprise one or more changes in the temperature setpoint.

13. The apparatus of claim 8, wherein the at least one processing device is configured to identify the second steady-state gain repeatedly during the operation of the furnace.

14. The apparatus of claim 8, wherein the at least one processing device is further configured to:

in response to identifying actual or potential flooding of the furnace, at least one of: generate an alert, alter the operation of the furnace, and stop the operation of the furnace.

15. A non-transitory computer readable medium containing instructions that when executed cause at least one processing device to:

identify a first steady-state gain associated with a relationship between a characteristic of a furnace and a setpoint used by a controller that is configured to control the characteristic of the furnace, using data collected when the furnace is not suffering from flooding;

identify a second steady-state gain associated with the relationship during operation of the furnace;

compare the first and second steady-state gains; and identify actual or potential flooding of the furnace based on the comparison.

16. The non-transitory computer readable medium of claim 15, wherein the instructions that when executed cause the at least one processing device to identify the second steady-state gain comprise:

instructions that when executed cause the at least one processing device to identify the second steady-state gain using data collected when the controller is operating in a closed-loop mode to control the characteristic of the furnace.

17. The non-transitory computer readable medium of claim 15, wherein:

the setpoint comprises a temperature setpoint; and the characteristic of the furnace comprises a flow rate of fuel gas into the furnace.

18. The non-transitory computer readable medium of claim 15, wherein the instructions that when executed cause the at least one processing device to identify the second steady-state gain comprise:

instructions that when executed cause the at least one processing device to identify the second steady-state gain using data collected after one or more perturbations in the setpoint.

19. The non-transitory computer readable medium of claim 18, wherein:

the setpoint comprises a temperature setpoint; and the one or more perturbations in the setpoint comprise one or more changes in the temperature setpoint.

20. The non-transitory computer readable medium of claim 15, wherein the instructions that when executed cause the at least one processing device to identify the second steady-state gain comprise:

instructions that when executed cause the at least one processing device to identify the second steady-state gain repeatedly during the operation of the furnace.

21. The non-transitory computer readable medium of claim 15, further containing instructions that when executed cause the at least one processing device to:

in response to identifying actual or potential flooding of the furnace, at least one of: generate an alert, alter the operation of the furnace, and stop the operation of the furnace.

22. The non-transitory computer readable medium of claim 15, wherein the instructions that when executed cause the at least one processing device to identify the first and second steady-state gains comprise:

instructions that when executed cause the at least one processing device to perform closed-loop model identification using data collected when the controller is controlling the characteristic of the furnace.

* * * * *